US010211568B2

(12) United States Patent
Blakborn et al.

(10) Patent No.: US 10,211,568 B2
(45) Date of Patent: Feb. 19, 2019

(54) PLUG CONNECTOR WITH LOCKING DEVICE

(71) Applicant: ROSENBERGER HOCHFREQUENZTECHNIK GMBH & CO. KG, Fridolfing (DE)

(72) Inventors: Willem Blakborn, Inzell (DE); Helmut Mühlfellner, Kirchanschoring (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/552,030

(22) PCT Filed: Jan. 14, 2016

(86) PCT No.: PCT/EP2016/000064
§ 371 (c)(1),
(2) Date: Aug. 18, 2017

(87) PCT Pub. No.: WO2016/134812
PCT Pub. Date: Sep. 1, 2016

(65) Prior Publication Data

US 2018/0040978 A1 Feb. 8, 2018

(30) Foreign Application Priority Data

Feb. 26, 2015 (DE) ..... 20 2015 001 505 U

(51) Int. Cl.
*H01R 13/627* (2006.01)
*H01R 13/508* (2006.01)

(52) U.S. Cl.
CPC ..... *H01R 13/6275* (2013.01); *H01R 13/508* (2013.01)

(58) Field of Classification Search
CPC ..... H01R 13/508; H01R 13/6275; H01R 13/6271; H01R 13/64
(Continued)

(56) References Cited

U.S. PATENT DOCUMENTS 5,201,670 A * 4/1993 Watanabe ..... H01R 13/62933 439/372
5,759,058 A * 6/1998 Childs ..... H01R 13/641 439/352

(Continued)

FOREIGN PATENT DOCUMENTS

CN 2896603 Y 5/2007
CN 103339804 A 10/2013

(Continued)

*Primary Examiner* — Tulsidas C Patel
*Assistant Examiner* — Travis Chambers
(74) *Attorney, Agent, or Firm* — DeLie, Peterson & Curcio, LLC; Robert Curcio

(57) ABSTRACT

A plug connector, in particular a high current plug, having a locking device for the play-free axial fixing of the plug connector with respect to a mating plug connector in a closed position coupled to the mating plug connector, wherein the locking device has a retaining element such as a latching clip to engage axially behind a locking projection on the mating plug connector in the closed position, and a mating pressure element which is located opposite the retaining element in such a way that the locking projection can be accommodated between the retaining element and the mating pressure element in the closed position. An actuating device for pressing on retaining element and/or mating pressure element is formed on the locking projection in a fixing position (II).

25 Claims, 3 Drawing Sheets

(58) Field of Classification Search
USPC ..... 439/345, 352, 374, 347, 372
See application file for complete search history.

(56) References Cited

U.S. PATENT DOCUMENTS

| | | | | |
|---|---|---|---|---|
| 7,591,665 | B2 * | 9/2009 | Nakamura | H01R 13/5812 439/374 |
| 7,682,181 | B1 * | 3/2010 | Jones, Jr. | H01R 13/6272 439/352 |
| 7,758,370 | B1 | 7/2010 | Flaherty | |
| 8,016,606 | B1 * | 9/2011 | Kwan | H01R 13/641 439/352 |
| 2005/0002734 | A1 | 1/2005 | Tsuji | |
| 2008/0139038 | A1 | 6/2008 | Lee | |
| 2014/0235085 | A1 | 8/2014 | Su | |
| 2014/0335720 | A1 * | 11/2014 | Like | H01R 13/645 439/374 |

FOREIGN PATENT DOCUMENTS

| | | | |
|---|---|---|---|
| CN | 103430396 | A | 12/2013 |
| DE | 69804714 | T2 | 2/2003 |
| DE | 69729362 | T2 | 6/2005 |
| EP | 1282202 | A1 | 2/2003 |
| EP | 1746691 | A2 | 1/2007 |
| JP | 2009-181933 | A | 8/2009 |

* cited by examiner

PLUG CONNECTOR WITH LOCKING DEVICE

BACKGROUND OF THE INVENTION

1. Field of the Invention

The invention relates to a plug connector, in particular a high-current plug, comprising a locking device for the axial fixing of the plug connector with respect to a mating plug connector in a closed position in which it is coupled to the mating plug connector. The locking device comprises, on the one hand, a retaining element such as a latching clip designed to engage axially behind a locking projection of the mating plug connector in the closed position and on the other hand a counter-pressure element which is located opposite the retaining element in such a way that the locking projection can be accommodated between the retaining element and the counter-pressure element in the closed position.

2. Description of Related Art

Plug connectors are used generally for the detachable connection of electrical cables or other electrical components in order to transmit current and/or electrical signals in the connected state. A first plug connector, for example a plug part, is plugged together with a complementary mating plug connector, for example a socket part, in order to form a plugged connection.

In motor vehicles with an electrified drive train, i.e., electric or hybrid vehicles, high electrical powers need to be transmitted from an energy source to a consumer. High-current cables and high-current plugs are generally used for this purpose which are designed for the transmission of high currents of up to 50 A or more. Plug connectors intended to be used directly on an engine block are thereby subjected to high mechanical stresses such as vibrations and oscillations, so that these plug connectors need to satisfy high requirements in terms of stability, durability etc.

In order to prevent a relative movement from taking place in the region of a plugged connection between a plug connector and a mating plug connector which leads to wear as a result of vibrations, conventional plug connectors are provided with a locking device by means of which, in a closed position in which it is coupled with the mating plug connector, the plug connector is held as firmly and immovably as possible relative to the mating plug connector, and by means of which the plug connector is also prevented from being pulled off or falling off the mating plug connector.

Known locking devices have retaining elements such as latching clips designed to clip over or behind locking projections such as locking catches of the mating plug connector in the closed position. When the plug connector is pushed on, the snap-locking tabs engage behind the relevant locking projection, which leads to a locking effect preventing the plug connector from being pulled off contrary to the plugging direction. In order to prevent the plug connector from being pushed onto the mating plug connector further than intended, a counter-pressure element can be provided, wherein, in the closed position, the locking projection of the mating plug connector is arranged in a space between the retaining element preventing it from being pulled off and the counter-pressure element preventing it from being pushed further. Such a snap-locking arrangement leads to a comparatively stable fixing of the plug connector on the mating plug connector.

However, it has been found that, in plugged connections which are subjected to particularly high mechanical loads and vibrations (for example vibration class 4), the described snap-locking connections lead to manifestations of wear and tear on the plug connector which can reduce the durability of the plugged connection.

SUMMARY OF THE INVENTION

In view of the problems described, it is the object of the present invention to further develop a plug connector such that it can also be used in plugged connections which are subjected to particularly high vibrations without being subject to manifestations of wear and tear.

This problem is solved according to the invention through a plug connector according to the independent claims. Advantageous further developments of the invention are described in the dependent claims.

The above and other objects, which will be apparent to those skilled in the art, are achieved in the present invention which is directed to a plug connector comprising a locking device for the play-free axial fixing of the plug connector with respect to a mating plug connector in a closed position coupled to the mating plug connector, wherein the locking device has a retaining element engaging axially behind a locking projection on the mating plug connector in the closed position and a counter-pressure element which is located opposite the retaining element in such a way that the locking projection can be accommodated between the retaining element and the counter-pressure element in the closed position, and an actuating device for pressing the counter-pressure element against the locking projection in a fixing position (II).

The retaining element and/or the counter-pressure element can be moved by the actuating device from a release position (I) with a first distance (A1) between the retaining element and the counter-pressure element into the fixing position (II) with a second distance (A2) between the retaining element and the counter-pressure element which is less than the first distance.

The counter-pressure element has a flexible part with a pressing surface designed to be pressed against a side of the locking projection facing the plug connector during coupling, and/or that the retaining element is designed as a rigid latching clip and has a pressing surface designed to be pressed against a side of the locking projection which faces away from the plug connector during coupling.

The retaining element and/or the counter-pressure element has a flexible part such as a bending part which has a first axial dimension in the release position (I) and a second axial dimension in the fixing position (II) which is larger than the first axial dimension.

The flexible part projects further, radially outwards, in the release position (I) than in the fixing position (II) and is preferably designed in the form of a leaf spring curving in an arc. Furthermore, the flexible part is pressed by the actuating device from a release position in which it is bent radially outwards into a flatter fixing position.

The actuating device has an actuating section which can be displaced in an axial direction (X) relative to the locking device and which can be pushed in the direction of the mating plug connector in order to move it into the fixing position (II) and/or can be pushed away from the mating plug connector in order to move it into the release position (I), or vice versa.

The actuating device has an axially displaceable sleeve part which surrounds a housing of the plug connector, at least in sections or completely. The actuating device can, at least in sections, be displaced beyond the flexible part and thereby press this into the flat fixing position (II) in which it is pre-loaded against the locking projection. Moreover, the actuating device can be fixed releasably in the fixing position (II) by a retaining mechanism.

The retaining element deflects radially outwards, at least in sections, during the course of coupling with the mating plug connector, and wherein the actuating device can only be moved into the fixing position (II) if the retaining element is not radially deflected.

The actuating device may have a grip section for radial deflection of the retaining element during movement from the fixing position (II) into the release position (I) in order to lift this over the locking projection during decoupling.

The plug connector further includes at least one inner conductor for conducting current, an outer conductor such as a shielding surrounding the inner conductor and a plug connector housing which includes the locking device and which is surrounded in a sleeve-like manner by the actuating device.

The plug connector may also include two locking devices on two opposite sides of the plug connector, the retaining elements and/or counter-pressure elements of which can be moved by the actuating device.

In a second aspect, the present invention is directed to a plugged connection comprising: a plug connector comprising a locking device for the play-free axial fixing of the plug connector with respect to a mating plug connector in a closed position coupled to the mating plug connector, wherein the locking device has a retaining element engaging axially behind a locking projection on the mating plug connector in the closed position and a counter-pressure element which is located opposite the retaining element in such a way that the locking projection can be accommodated between the retaining element and the counter-pressure element in the closed position, and an actuating device for pressing the counter-pressure element against the locking projection in a fixing position (II); and a complementary mating plug connector designed to be coupled with the plug connector, wherein the mating plug connector has at least one locking projection, projecting radially outwards, which in the closed position can be accommodated between the retaining element and the counter-pressure element of the plug connector.

The mating plug connector has at least one sloping surface extending towards the locking projection in order to deflect the retaining element radially during coupling in order to guide this into the position in which it engages behind the locking projection.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
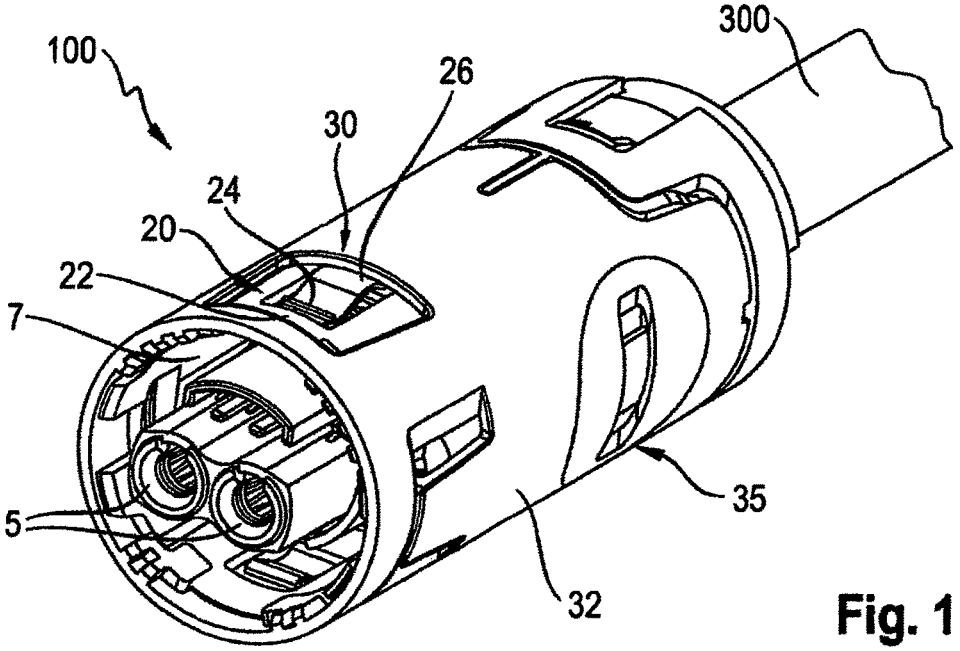
FIG. 1 shows a plug connector according to the invention in a perspective view.

In describing the preferred embodiment of the present invention, reference will be made herein to FIGS. 1-4 of the drawings in which like numerals refer to like features of the invention.

A plug connector according to the invention has an actuating device which is designed to press the retaining element and/or the counter-pressure element against the locking projection of the mating plug connector which is arranged between these. The retaining element and/or the counter-pressure element are thereby moved, by means of the actuating device, from a release position into a fixing position in which the retaining element and/or the counter-pressure element are pressed more forcefully against the locking projection than in the release position.

In other words, the actuating device serves to press the retaining element in the direction of the counter-pressure element in order to reduce the distance between these and/or to press the counter-pressure element in the direction of the retaining element in order to reduce the distance between these. As a result, the retaining element and counter-pressure element can be pressed against the locking projection arranged between these from both sides and thus remove any axial play from the plugged connection.

To put it another way, the actuating device serves to move the retaining element and/or the counter-pressure element from a release position with a first distance between the retaining element and the counter-pressure element into a fixing position with a second distance between the retaining element and the counter-pressure element which is less than the first distance in order to press the retaining element and counter-pressure element against the locking projection from both sides.

The invention is based on the knowledge that, in conventional snap-locking mechanisms, in the nature of things a slight axial play between a retaining element in the form of a latching clip and the locking projection is present in the closed position in order to make a snap-locking engagement possible in the first place. This is because, due to the coupling force applied in the plugging direction, after snapping into engagement the retaining element does not rest directly against the locking projection but remains at a small distance behind this, whereby the axial play resulting from this distance leads to the manifestations of wear described above. According to the invention, an actuating device is now provided in order to completely eliminate this axial play otherwise initially present by moving the retaining element and/or the counter-pressure element opposite this into the fixing position. As a result of the reduction in the distance between the counter-pressure element and the retaining element, the retaining element is pushed or drawn, contrary to the plugging direction, back into contact with the locking projection, while the counter-pressure element comes to rest against the opposite side of the locking projection. In other words, the second distance is so small in the fixing position that the locking projection is in contact with both the retaining element and also the counter-pressure element, and in this way is accommodated between these two elements completely without axial play. Thus, on the one hand the configuration of the locking device according to the invention facilitates the coupling operation, and on the other hand it makes possible a rigid, completely play-free axial connection between the plug connector and the mating plug connector.

The second axial distance between the retaining element and the counter-pressure element in the fixing position preferably corresponds to the axial width of the locking projection, so that after the actuating device has been moved into the fixing position the locking projection can be accommodated in the space between the retaining element and counter-pressure element in a play-free manner.

In order to achieve a user-friendly and simple movement into the fixing position and, conversely, into the release position, it has proved expedient if the counter-pressure element is designed as a movable, flexible part, for example as a bending part, and has a pressing surface designed to be pressed against a side of the locking projection facing the plug connector during coupling by means of the actuating device. When the pressing surface of the movable bending part presses against the locking projection, a section of the retaining element which engages over the locking projection which has been pushed too far forward in the plugging direction is drawn back until it comes to rest against the opposite side of the locking projection. In other words, the retaining element and the housing of the plug connector which is rigidly connected thereto is drawn back, contrary to the plugging direction, until any axial play is removed from the plugged connection and the retaining element and bending part are pressed against the locking projection from both sides. A further advantage of using a flexible part as a counter-pressure element is that it can be pressed against the locking projection in a pre-loaded manner.

On the other hand, advantageously, the retaining element is designed not as a flexible part such as a bending part but as a rigid latching clip or as a rigid snap-locking tab which has a pressing surface for pressing against a side of the locking projection which faces away from the plug connector during coupling. The pressing surface of the bending part lies opposite the pressing surface of the retaining element spaced apart at the first distance (release position) or at the second distance (fixing position). A rigid and stable retaining element leads to a good and stable snap-locking engagement between the plug connector and the mating plug connector.

In an alternative embodiment, the retaining element can also have a flexible part such as a movable bending part.

Preferably, the counter-pressure element is designed as the flexible part and has a first axial dimension in the release position and a second axial dimension in the fixing position which is larger than the first axial dimension. In the release position, the flexible part has the shorter axial dimension and thus projects less far in the direction of the retaining element, so that the distance between the retaining element and the front end of the flexible part is large (first distance). In the fixing position, the flexible part has the larger axial dimension and thus projects further in the direction of the retaining element, so that the distance between the retaining element and the front end of the flexible part is small (second distance), in order to press against the locking projection of the mating plug connector.

The flexible part can be designed as a leaf spring element which has the pressing surface at its free, plug-side end, the rear end opposite the free end being fixed to the housing of the plug connector. A counter-pressure element designed as a flexible part or as an elastically movable bending part can be adjusted by means of the actuating device in a particularly simple and reliable manner in order to adjust a specified contact pressure.

The "distance" between the retaining element and the counter-pressure element is thereby understood to mean the distance between the pressing surfaces of the retaining element and counter-pressure element which are arranged opposite one another.

A change in the axial length of the bending part can be effected in that the bending part projects further, radially outwards, in the release position than in the fixing position. The radial extension component of the bending part in the release position can be bent, at least partially, into an axial extension component by means of the actuating device, wherein the bending part is elastically pre-loaded in the fixing position. Preferably, the bending part is designed in the form of a leaf spring curving in an arc, wherein the arc, extending radially in a longitudinal sectional plane, is more pronounced in the release position than in the fixing position, in which the bending part is pressed flat.

In a particularly preferred embodiment of the invention, the bending part is configured such that it can be pressed by means of the actuating device from a position in which it is bent radially outwards into a flatter and more axially extended position (fixing position).

For this purpose, the actuating device preferably has an actuating section which can be displaced in an axial direction relative to the locking device and which, in order to move it into the fixing position, is pushed in the direction of the plug-side end of the plug connector and/or is pushed in the opposite direction (away from the mating plug connector) in order to move it into the release position, or vice versa. By moving the actuating section in the direction of the plug-side end of the plug connector, the bending element can be elastically pre-loaded against the locking projection of the mating plug connector. By moving the actuating section back into its initial position, the pre-loading of the bending element can be released again, as a result of which the bending element automatically pulls back into a relaxed position in which it presses less forcefully against the locking projection of the mating plug connector.

A particularly simple and user-friendly actuation of the actuating section is made possible in that the actuating section is a sleeve part which surrounds a housing of the plug connector, at least in sections, preferably completely. For example, the actuating section is designed as an axially displaceable plastic sleeve surrounding the plug connector housing, which offers the user a particularly large gripping surface. In order to move it into the fixing position, the actuating section can preferably be pushed, at least in sections, beyond the bending part, whereby the bending part can thereby be pressed from a bent-outwards position into the axially extended fixing position. A sleeve part offers the further advantage of high stiffness and strength, so that an independent radial deflection or evasion of the pre-loaded bending part is reliably prevented when the sleeve part lies against it radially on the outside and presses this inwards.

In order to achieve a reliable securing of the plug connector coupled with the mating plug connector in the fixing position, the actuating device preferably has a retaining mechanism such as a latching mechanism for fixing the plug connector in the fixing position. The latching mechanism leads for example to an automatic snap-locking engagement of the sleeve part, following its axial displacement in the direction of the mating plug connector, as soon as the counter-pressure element has been moved into the fixing position. The latching mechanism can be formed through the form-locking interaction of snap-locking tabs and snap-locking projections which are provided, on the one hand, on the axially displaceable actuating device and on the other hand on an axially fixed housing of the plug connector.

The retaining mechanism can be released manually in order to reset the actuating device into the release position, for example through actuation of one or more release sections, which can be provided on the sleeve part.

Known high-current plugs are frequently equipped with plug connector position-securing features ("CPA": connector position assurance) which can only be actuated once the plug connector is arranged in its final position relative to the mating plug connector. If an actuation of the CPA is not possible, the installer of the plug connector receives the information that the coupling procedure is incomplete and the plug connector is not arranged in its final closed position. This is intended to prevent the release of current flows through defectively coupled plugged connections.

In the plug connector according to the invention, such a connector position assurance (CPA) can be provided in that the retaining element is designed so as to be able to deflect radially outwards, at least in sections, during the course of coupling with the mating plug connector, wherein the actuating device is designed such that it can only be moved into the fixing position if the retaining element is not radially deflected. The deflection of the retaining element radially outwards during the course of the coupling operation can be effected in that the retaining element is forced outwards through sloping guide surfaces of the mating plug connector until it snaps into engagement, radially inwards, behind the locking projection. The axially displaceable actuating device comes to rest against a radially deflected retaining element which has not yet snapped back into engagement and cannot be pushed into the fixing position. Through this contact, the installer of the plug connector receives the information that the plug connector is not yet in the final closed position. On the other hand, a radial deflection of the retaining element beyond the locking projection can be prevented in that the actuating device lies against it on the outside in the fixing position.

This CPA is particularly effective if the actuating device is designed as an axially displaceable surrounding sleeve part which contains an opening such as a window through which the retaining element can only be deflected radially outwards if the actuating device is in the release position. If, in contrast, the actuating device is in the fixing position, the retaining element is, at least in sections, not arranged on the axial level of the opening, but on the axial level of the closed part of the sleeve wall, which prevents a radial deflection of the retaining element.

The decoupling of a plug connector from the mating plug connector can be simplified in that the actuating device has a grip section for radial deflection of the retaining element during movement from the fixing position into the release position allowing this to be lifted over the locking projection during decoupling. In other words, as a result of a movement of the actuating device from the fixing position into the release position, not only is the counter-pressure element released from the locking projection, the retaining element engaging behind the locking projection is also lifted, so that the plug connector can be pulled off the mating plug connector in a simple and user-friendly manner simply by moving the actuating device into the release position. For this purpose, the retaining element can have a lever surface such as a sloping surface which makes it possible for it to be engaged and lifted by the grip section of the actuating device.

The plug connector according to the invention preferably has at least one or more inner conductors for conducting current, preferably an outer conductor such as a shielding surrounding the inner conductor and, in addition, a plug connector housing which includes the locking device.

One or more sealing elements such as silicon or rubber parts can be provided on the housing which are intended to lie against a sealing surface of the mating plug connector in order to guarantee a water-tight or gas-tight plugged connection.

In a particularly preferred embodiment of the invention, the housing of the plug connector is surrounded by the actuating device, at least in sections, in the manner of a sleeve.

In order to achieve a particularly stable and durable plugged connection between the plug connector according to the invention and a complementary mating plug connector, it has proved expedient if two or more locking devices are provided on two opposite sides of the plug connector (preferably offset by 180° in the circumferential direction), the retaining elements and/or counter-pressure elements of which can be moved by means of a single actuating device such as a surrounding sleeve part.

According to a further aspect, the invention relates to a plugged connection comprising a plug connector according to the invention and a complementary mating plug connector designed to be coupled with the plug connector. The plug connector can exhibit the features described above individually or in any combination, whereby in order to avoid repetition these features will not be described again.

The mating plug connector has at least one locking projection, projecting radially outwards, which in the closed position can be accommodated between the retaining element and the counter-pressure element of the plug connector.

By moving the counter-pressure element into the fixing position, a pressing surface of the counter-pressure element is pressed against the locking projection such that the retaining element which is opposite the counter-pressure element and engages over the locking projection is drawn back to rest against the other side of the locking projection. The distance between the retaining element and the counter-pressure element in the fixing position thus corresponds exactly to the axial dimension of the locking projection (second distance).

The mating plug connector also comprises at least one inner conductor designed to make electrical contact with the inner conductor of the plug connector in the closed position, preferably an outer conductor surrounding the inner conductor such as a shielding and in addition a housing, starting out from which the locking projection can project radially outwards. The housing can a have a cylinder-barrel-formed wall which in the closed position lies in a sealing manner against a sealing element of the plug connector.

In order to provide an effective CPA, the mating plug connector has at least one sloping surface extending towards the locking projection in order to deflect the retaining element radially during coupling in order to guide this into the position in which it engages behind the locking projection. When, during the course of the coupling operation, the retaining element is positioned at the level of the sloping surface and is deflected radially outwards, the actuating element cannot be pushed axially in the direction of the mating plug connector into the fixing position, since it comes up against the radially deflected retaining element.

Only after the retaining element engages behind the locking projection is an axial displacement of the actuating device possible.

In order to achieve a simplification of the coupling operation, it has proved advantageous if the mating plug connector has at least one axially extending guide projection and the plug connector has at least one complementary guide groove or vice versa, so that the plug connector can only be inserted in the mating plug connector in a correct rotational position in which the guide projections engage in the guide grooves.

In the following description, the invention is described with reference to the attached drawings in which express reference is made to details which are important to the invention and which are not explained in detail in the description.

Figure 2:
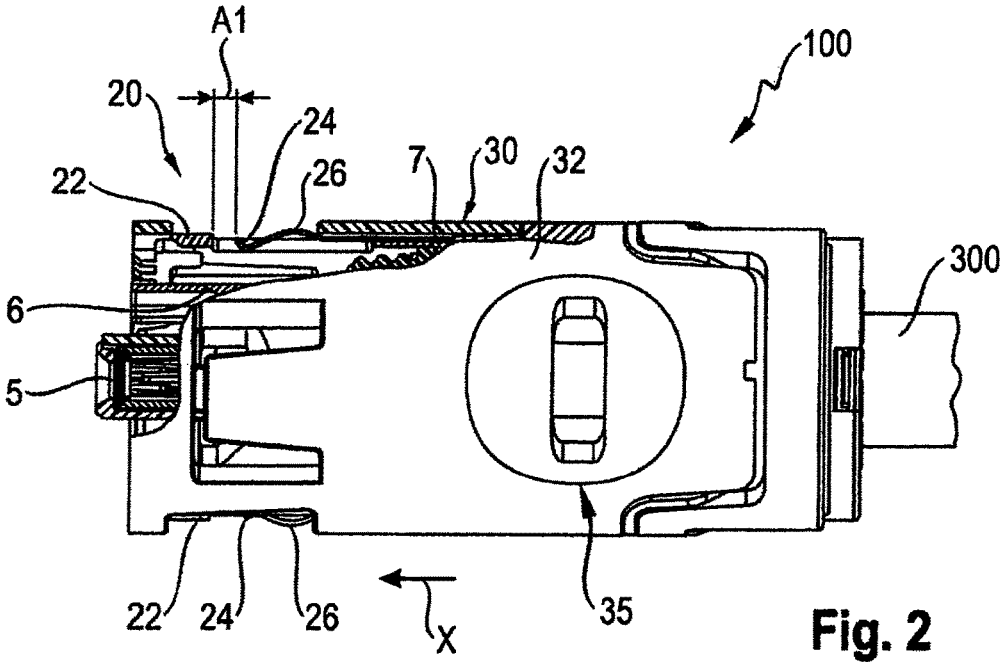
FIG. 2 shows a plug connector according to the invention in a side view, partially represented in the form of a longitudinal section.

FIG. 1 shows a perspective view of an embodiment of a plug connector 100 according to the invention. FIG. 2 shows the plug connector 100 in a longitudinal sectional view. The plug connector 100 is a high-current plug which is attached to the front end of a cable 300 for the purpose of transmitting high currents. The plug connector 100 is designed to be coupled with a complementary mating plug connector 200 in the form of a high-current socket, as illustrated on the left in FIG. 3*a*.

The plug connector has two inner conductors 5 for conducting current, an outer conductor 6 with a spring bush surrounding the inner conductor 5 and a dielectric in the form of an insulating part arranged between these, at least in sections. The inner conductors 5 are crimped onto inner conductors of the cable 300 and the outer conductor 6 is crimped together with an outer conductor of the cable. The plug connector 100 also has a housing 7 which is in the form of a plastic component and which surrounds the front end of the cable 300 as well as the outer conductor 6 of the plug connector, at least in sections. A sealing part is arranged between the plug connector housing 7 and a cable sheath for sealing purposes.

The plug connector 100 can be pushed axially, in a plugging direction X, onto a housing part 205 of the mating plug connector 200 for the purpose of coupling. A second sealing part 310 of the plug connector thereby comes to rest, in a sealing manner, against the housing part 205 of the mating plug connector 200.

The plug connector 100 has a locking device 20 which ensures a play-free axial fixing of the plug connector relative to the mating plug connector in the closed position. The locking device 20 comprises, on the one hand, a retaining element 22 in the form of a latching clip designed to engage axially behind a locking projection 202 of the mating plug connector 200 and on the other hand a counter-pressure element 24 with a flexible leaf spring 26 which is arranged opposite the retaining element 22. A space is formed between a pressing surface of the retaining element 22 and a pressing surface of the counter-pressure element 24 to accommodate the locking projection 202 of the mating plug connector. In the release position I illustrated in FIG. 2 this space has an axial dimension (first distance A1).

Figure 4:
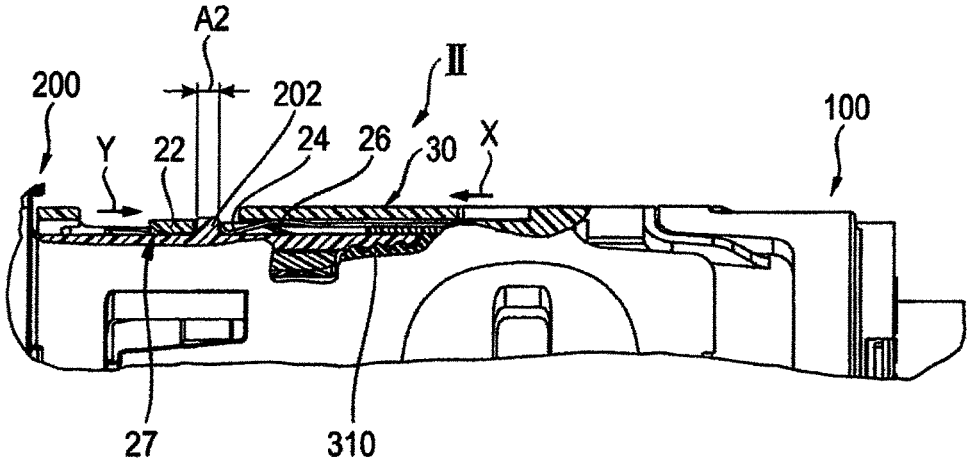
FIG. 4 shows a partial view of the plugged connection shown in FIG. 3*c* in longitudinal section.

As indicated in FIG. 4, when the retaining element 22 snaps back behind the locking projection 202 when pushed onto the mating plug connector 200, a small space is formed between the retaining element 22 and the locking projection 202. In other words, the retaining element 22 does not lie directly against the locking projection 202 after snapping back. This axial play can be eliminated by means of an actuating device 30.

The counter-pressure element 24 can be moved, by means of the actuating device 30, into a fixing position II (see FIG. 4) in which it is pressed against the locking projection 202. As a result, the retaining element 22, designed in the form of a rigid latching clip, is drawn back to rest directly against the opposite side of the locking projection and thus also presses against the locking projection (see arrow Y in FIG. 4). The locking section 202 is thus accommodated, in a play-free and pre-loaded manner, in the space between the retaining element 22 and the counter-pressure element 24. In the fixing position, the distance between the retaining element 22 and the counter-pressure element 24 corresponds to the axial dimension of the locking projection 202 (second distance A2) and is thus smaller than the first distance A1 in the release position.

The counter-pressure element 24 comprises the leaf spring 26 which curves in an arc, the front free end of which carries the pressing surface, the opposite rear end being attached to the housing 7. On application of an axial compressive force on a region of the leaf spring which slopes radially outwards, this is pressed into a flatter and more longitudinally extended position in which it projects further in the direction of the retaining element 22 than in the relaxed starting position in which it curves in an arc.

The actuating device 30 is designed as a sleeve part 32 surrounding the housing 7 of the plug connector which is held in an axially displaceable manner on the housing. A displacement of the sleeve part 32 in the direction X towards the mating plug connector leads to an edge section of the sleeve part 32 pressing axially against the leaf spring 26 and pressing this, as described in the preceding paragraph, in the direction of the retaining element 22 or in the direction of the locking projection 202 (see FIG. 4).

Figure 3A:
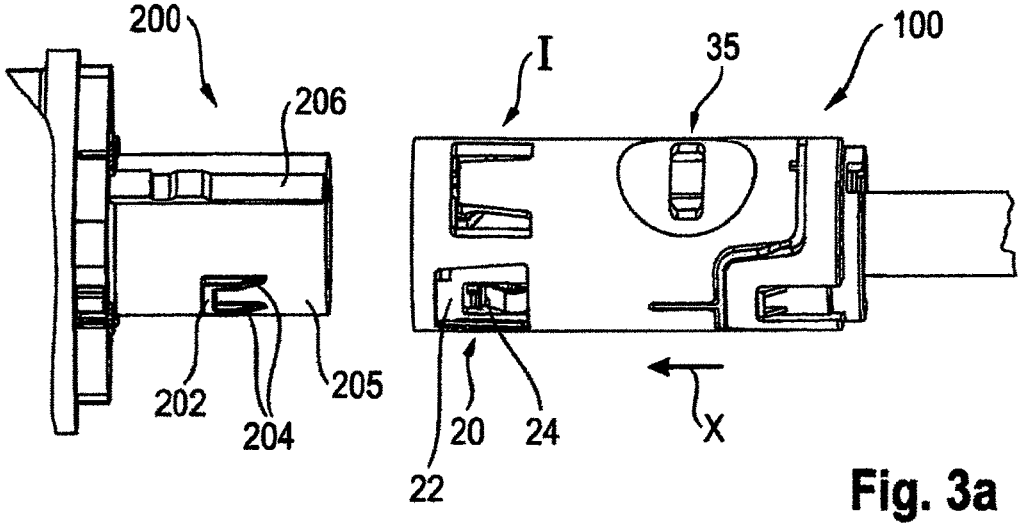
FIGS. 3*a* to 3*c* show steps during coupling of the plug connector shown in FIGS. 1 and 2 with a mating plug connector in order to create a plugged connection according to the invention.
Figure 3B:
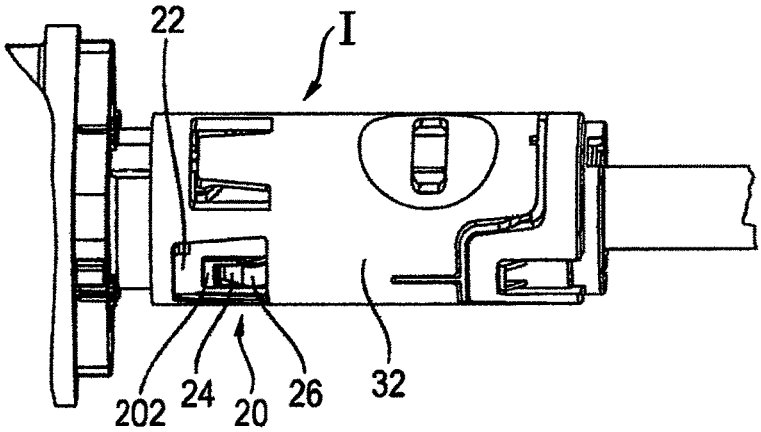
Figure 3C:
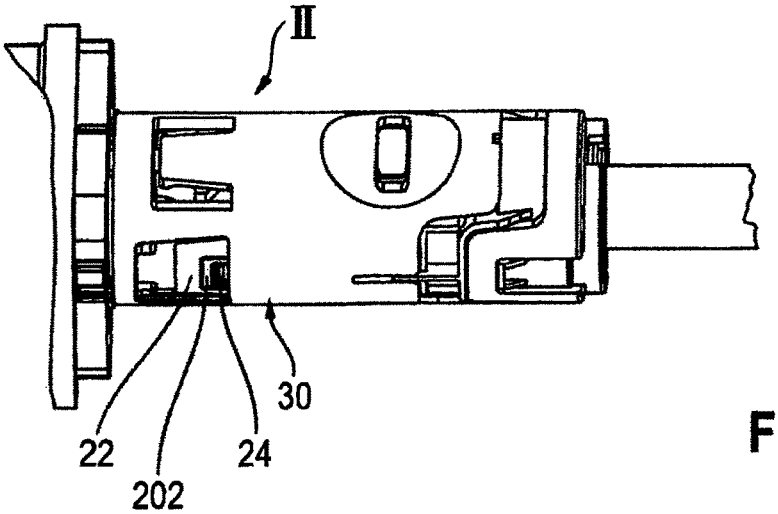

In FIG. 3*b*, the sleeve part 32 and the leaf spring 26 are in the release position I and in FIG. 3*c* the sleeve part 32 has been pushed axially in the direction X until it comes to rest against a limit stop on the mating plug connector. In this fixing position II, the leaf spring 26 is pressed into the described flat position by a wall section of the sleeve part 32 pressing against it on the outside.

The actuating device 30 has a latching mechanism 35 which, following the movement into the fixing position II, automatically leads to an axial fixing of the actuating device 30. The latching mechanism 35 can be released again by applying pressure to two grip tabs, as a result of which the actuating device can be pulled back into the release position.

As illustrated in FIG. 2, the plug connector has two locking devices 20 on the housing 7 which are offset by 180°, whereby the counter-pressure elements 24 of the two locking devices 20 can be moved simultaneously by means of the actuating device 30 which is designed as a sleeve part 32.

The "connector position assurance" (CPA) provided on the plugged connection according to the invention is explained in the following:

As illustrated in FIG. 3*a*, the housing 205 of the mating plug connector 200 has sloping surfaces 204 which deflect the retaining element 22 of the plug connector radially outwards during coupling until this snaps into engagement behind the locking projection 202 and latches behind this. If the retaining element 22 is radially deflected and is not yet in its end position behind the locking projection 202, it is not possible to displace the sleeve part 32 axially in the plugging direction X, since it is obstructed by the deflected retaining element 22. A displacement of the sleeve part 32 into the fixing position II shown in FIG. 3*c* is only possible if the retaining element has snapped into the correct end position.

On the other hand, a radial deflection of the retaining element 22 is prevented due to the part of the sleeve wall which lies closely against it on the outside in the fixing position II, so that the snap-locking mechanism is secured against accidental release.

Guide projections 206 arranged on the mating plug connector, each of which is associated with a complementary guide groove of the plug connector, ensure that the plug connector is arranged in a correct rotational position during coupling.

FIGS. 3*a* to 3*b* show steps during the coupling of the plug connector 100 with the mating plug connector 200 in order to create a plugged connection according to the invention:

FIG. 3*a* shows the plug connector 100 and the mating plug connector 200 opposite this prior to coupling.

FIG. 3*b* shows the plug connector 100 pushed onto the mating plug connector 200, wherein the retaining element 22 already engages behind the locking projection 202 of the mating plug connector 200, preventing the plug connector from being pulled off. However, there is still some axial play between the retaining element 22, the locking projection 202 and/or the counter-pressure element 24. The actuating device is located in the release position I in which, while the counter-pressure element 202 may already be resting against the locking projection 202, it is not pressed against it with force by means of the actuating device.

FIG. 3*c* shows the actuating device 30 after it has been moved into the fixing position II. The retaining element 22 and the counter-pressure element 24 are pressed against the locking projection 202 in a play-free manner. The counter-pressure element 24 is thereby held, at least in sections, in a flat position, pressed against the locking projection 202, by a wall section of the sleeve part 32. The latching mechanism 35 prevents an axial movement of the sleeve part 32 back into the release position I.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector assembly comprising a locking device for the play-free axial fixing of the plug connector with respect to a mating plug connector in a closed position coupled to the mating plug connector, wherein the locking device has a retaining element engaging axially behind a locking projection on the mating plug connector in the closed position and a counter-pressure element which is located opposite the retaining element in such a way that the locking projection can be accommodated between the retaining element and the counter-pressure element in the closed position, and an actuating device for pressing the counter-pressure element against the locking projection in a fixing position (II).

2. The plug connector assembly of claim 1, wherein the retaining element and/or the counter-pressure element can be moved by the actuating device from a release position (I) with a first distance ($A_1$) between the retaining element and the counter-pressure element into the fixing position (II) with a second distance ($A_2$) between the retaining element and the counter-pressure element which is less than the first distance.

3. The plug connector assembly of claim 1 including at least one inner conductor for conducting current, an outer conductor such as a shielding surrounding the inner conductor and a plug connector housing which includes the locking device and which is surrounded in a sleeve-like manner by the actuating device.

4. The plug connector assembly of claim 1 including two locking devices on two opposite sides of the plug connector, the retaining elements and/or counter-pressure elements of which can be moved by the actuating device.

5. The plug connector of claim 1 wherein said retaining element is a latching clip.

6. The plug connector assembly of claim 1, wherein the counter-pressure element has a flexible part with a pressing surface designed to be pressed against a side of the locking projection facing the plug connector during coupling, and/or that the retaining element is designed as a rigid latching clip and has a pressing surface designed to be pressed against a side of the locking projection which faces away from the plug connector during coupling.

7. The plug connector assembly of claim 6, wherein the flexible part is pressed by the actuating device from a release position in which it is bent radially outwards into a flatter fixing position.

8. The plug connector assembly of claim 1, wherein the actuating device has an axially displaceable sleeve part which surrounds a housing of the plug connector, at least in sections or completely.

9. The plug connector assembly of claim 8, wherein the actuating device can, at least in sections, be displaced beyond the flexible part and thereby press this into the flat fixing position (II) in which it is pre-loaded against the locking projection.

10. The plug connector assembly of claim 1, wherein the retaining element deflects radially outwards, at least in sections, during the course of coupling with the mating plug connector, and wherein the actuating device can only be moved into the fixing position (II) if the retaining element is not radially deflected.

11. The plug connector assembly of claim 10, wherein the actuating device has a grip section for radial deflection of the retaining element during movement from the fixing position (II) into the release position (1) in order to lift this over the locking projection during decoupling.

12. The plug connector of claim 1, wherein the actuating device is designed to press the retaining element and the counter-pressure element against the locking projection in a fixing position.

13. The plug connector of claim 12, wherein the retaining element and/or the counter-pressure element has a flexible part such as a bending part which has a first axial dimension in the release position (I) and a second axial dimension in the fixing position (II) which is larger than the first axial dimension.

14. The plug connector of claim 12, wherein the retaining element and/or the counter-pressure element can be moved by the actuating device from a release position with a first distance ($A_1$) between the retaining element and the counter-pressure element into the fixing position with a second distance ($A_2$) between the retaining element and the counter-pressure element which is less than the first distance.

15. The plug connector of claim 14, wherein the counter-pressure element has a flexible part with a pressing surface designed to be pressed against a side of the locking projection facing the plug connector during coupling, and/or that the retaining element is designed as a rigid latching clip and has a pressing surface designed to be pressed against a side of the locking projection which faces away from the plug connector during coupling.

16. The plug connector assembly of claim 1, wherein the retaining element and/or the counter-pressure element has a flexible part which has a first axial dimension in the release position (I) and a second axial dimension in the fixing position (II) which is larger than the first axial dimension.

17. The plug connector of claim 16, wherein the flexible part projects further, radially outwards, in the release position (I) than in the fixing position (II) and is preferably designed in the form of a leaf spring curving in an arc.

18. The plug connector assembly of claim 6, wherein the flexible part projects further, radially outwards, in the release position (I) than in the fixing position (II) and is designed in the form of a leaf spring curving in an arc.

19. The plug connector of claim 18, wherein the flexible part is pressed by the actuating device from a release position in which it is bent radially outwards into a flatter fixing position.

20. The plug connector assembly of claim 1, wherein the actuating device has an actuating section which can be displaced in an axial direction (X) relative to the locking device and which can be pushed in the direction of the mating plug connector in order to move it into the fixing position (II) and/or can be pushed away from the mating plug connector in order to move it into the release position (I), or vice versa.

21. The plug connector of claim 20, wherein the actuating device has an axially displaceable sleeve part which surrounds a housing of the plug connector, at least in sections or completely.

22. The plug connector assembly of claim 1, wherein the actuating device can be fixed releasably in the fixing position (II) by a retaining mechanism.

23. The plug connector of claim 22, wherein the retaining mechanism includes snap locking tabs.

24. A plugged connection comprising:

a plug connector comprising a locking device for the play-free axial fixing of the plug connector with respect to a mating plug connector in a closed position coupled to the mating plug connector, wherein the locking device has a retaining element engaging axially behind a locking projection on the mating plug connector in the closed position and a counter-pressure element which is located opposite the retaining element in such a way that the locking projection can be accommodated between the retaining element and the counter-pressure element in the closed position, and an actuating device for pressing the counter-pressure element against the locking projection in a fixing position (II); and a complementary mating plug connector designed to be coupled with said plug connector, wherein the mating plug connector has at least one locking projection, projecting radially outwards, which in the closed position can be accommodated between the retaining element and the counter-pressure element of the plug connector.

25. The plugged connection according to claim 24, wherein the mating plug connector has at least one sloping surface extending towards the locking projection in order to deflect the retaining element radially during coupling in order to guide this into the position in which it engages behind the locking projection.

* * * * *